US007548212B2

(12) United States Patent
Chekroun et al.

(10) Patent No.: US 7,548,212 B2
(45) Date of Patent: Jun. 16, 2009

(54) CYLINDRICAL ELECTRONICALLY SCANNED ANTENNA

(75) Inventors: Claude Chekroun, Gif sur Yvette (FR); Michel Soiron, Chavenay (FR)

(73) Assignee: Thales (FR)

( * ) Notice: Subject to any disclaimer, the term of this patent is extended or adjusted under 35 U.S.C. 154(b) by 93 days.

(21) Appl. No.: 11/759,081

(22) Filed: Jun. 6, 2007

(65) Prior Publication Data

US 2008/0088520 A1 Apr. 17, 2008

(30) Foreign Application Priority Data

Jun. 6, 2006 (FR) ..... 06 05005

(51) Int. Cl.
*H01Q 19/06* (2006.01)
*H01Q 13/00* (2006.01)

(52) U.S. Cl. ..... 343/754; 343/772

(58) Field of Classification Search ..... 343/754, 343/768, 770, 771, 772, 776
See application file for complete search history.

(56) References Cited

U.S. PATENT DOCUMENTS 2,711,440 A * 6/1955 Rines ..... 342/179
2,807,018 A 9/1957 Woodward, Jr.
2,836,822 A * 5/1958 Ehrlich et al. ..... 343/754
3,699,574 A * 10/1972 O'Hara et al. ..... 342/154
4,247,858 A 1/1981 Eichweber
4,458,250 A 7/1984 Bodnar et al.
6,429,822 B1 * 8/2002 Naudin et al. ..... 343/754

FOREIGN PATENT DOCUMENTS

EP 1139484 10/2001

OTHER PUBLICATIONS

Tasseti, C. M., G. Bazin-Lissorgues, J. P. Gilles and P. Nicole, "New Tunable MEMS Inductors Design for RF and Microwave Applications", MEMSWAVE Conference 2003, Jul. 2-4, 2003, Toulouse, France, pp. 1-4.

* cited by examiner

*Primary Examiner*—Hoang V Nguyen
(74) *Attorney, Agent, or Firm*—Lowe Hauptman Ham & Berner, LLP

(57) ABSTRACT

The present invention relates to a cylindrical electronically scanned antenna.
The antenna has:
a set of radiating guides (2) arranged in cylinder form for, producing the antenna beam (8); An array (3) of 3 dB couplers is arranged in waveguide form. The inputs of the array are lit by a set of microwave feeds (4). The output of each coupler is coupled to the input of a radiating guide (2). An array of pairs of phase-shifting cells is, each coupled to a 3 dB coupler. An incoming wave from the microwave feeds (4) is phase-shifted by a controllable phase shift $\Delta\phi$. The angular offset of the antenna beam (8) is dependent on this phase shift $\Delta\phi$. The invention is typically applicable for equipping masts, in particular on ships.

11 Claims, 5 Drawing Sheets

CYLINDRICAL ELECTRONICALLY SCANNED ANTENNA

RELATED APPLICATIONS

The present application is based on, and claims priority from, FRENCH Application Number 06 05005, filed Jun. 6, 2007, the disclosure of which is hereby incorporated by reference herein in its entirety.

FIELD OF THE INVENTION

The present invention relates to a cylindrical electronically scanned antenna. It is typically applicable for equipping masts, in particular on ships.

BACKGROUND OF THE INVENTION

Electronically scanned antennas, normally flat, are ill-suited to circular panoramic applications, unless they are equipped with a mechanical rotating device. Another solution involves juxtaposing several flat antenna panels to cover all 360°. These solutions are complex or costly to implement. For these reasons in particular, they are ill-suited, or even not at all suited, to applications such as, for example, marine telecommunication antennas installed at the top of masts.

One aim of the invention is in particular to make it possible to simply produce a cylindrical antenna. To this end, the subject of the invention is a cylindrical electronically scanned antenna comprising at least:

- a set of radiating guides arranged in cylinder form, producing the antenna beam;
- an array of 3 dB couplers in waveguide form, the inputs of which are lit by a set of microwave feeds, the output of a coupler being coupled to the input of a radiating guide;
- an array of pairs of phase-shifting cells, each coupled to a 3 dB coupler, an incoming wave from the microwave feeds being phase-shifted by a controllable phase shift $\Delta\phi$, the angular offset of the antenna beam being dependent on this phase shift.

Advantageously, the microwave feeds are arranged on a cylindrical circumference inside the cylinder formed by the set of radiating guides so that each feed lights a part of the array of couplers, the microwave feeds being activated in turn.

The microwave feeds are, for example, horns linked to a microwave line switching device, each horn supplied by a line.

Advantageously, the switching device is, for example, an SP8T-type device. This switch can be MEMS-based.

In one embodiment, the incoming wave entering the input of a coupler is split into two waves, these two waves each being reflected on a phase-shifting cell with identical phases and being recombined into a resultant phase-shifted wave leaving via the output of the coupler juxtaposed to the input.

The phase-shifting cells comprise, for example, diodes, the applied phase shift being dependent on the state of the diodes.

In another embodiment, the phase-shifting cells comprise, for example, tunable MEMS, the applied phase shift being dependent on the impedance of the MEMS, this impedance being controllable.

The microwave feeds are, for example, arranged on an internal cylindrical wall, the feeds lighting the couplers in the available space between the internal wall and the radiating guides.

The radiating guides are, for example, slotted guides.

SUMMARY OF THE INVENTION

The main advantages of the invention are that it exhibits low losses, and that it is simple to produce, compact and inexpensive.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWING

Other characteristics and advantages of the invention will become apparent with the aid of the description which follows in conjunction with the appended drawings which represent.

DETAILED DESCRIPTION OF THE DRAWING

Figure 1:
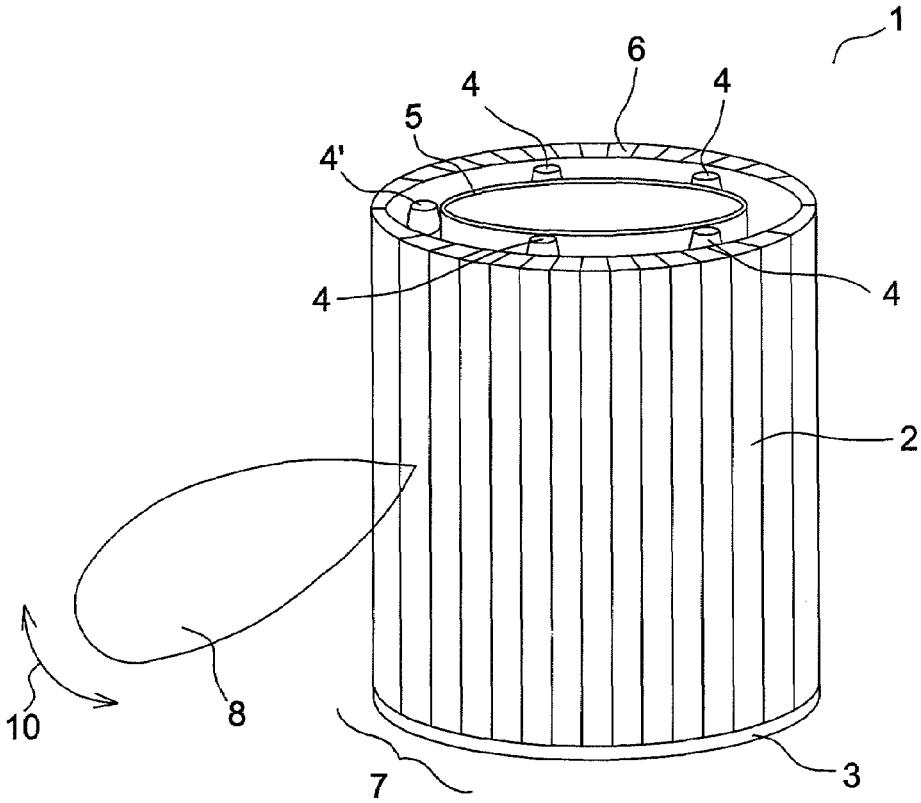
FIG. 1, a cylindrical antenna according to the invention.

FIG. 1 shows the general appearance of an antenna 1 according to the invention. This antenna comprises a series of radiating guides 2 arranged parallel to each other and forming a cylinder. These radiating guides 2 are supplied by an array of phase shifters 3, which is itself illuminated by microwave feeds 4, 4' distributed in circular fashion. The array of phase shifters 3 is arranged at the base of the cylinder. The feeds 4 are, for example, fixed on an internal support 5. To satisfy the mechanical rigidity requirements, the guides are, for example, fixed on an armature 6 concentric to said internal support 5. A cluster 7 of contiguous radiating guides 2 produces an antenna beam 8. This beam is produced by the guides illuminated by a microwave feed 4', via the phase shifters of the array 3, the other feeds 4 being inactive. The microwave feeds 4 are activated in turn so as to rotate the antenna beam 8. The method of supplying the feeds 4, 4' and the control of the phase shifters producing the movements of the antenna beam 8 will be described later.

Figure 2:
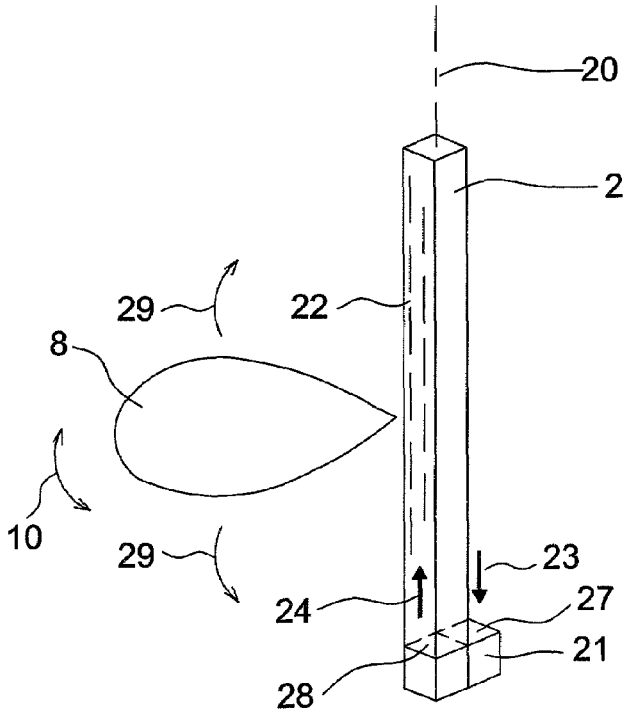
FIG. 2, a radiating guide and its associated phase shifter used in an antenna according to the invention.

FIG. 2 illustrates a radiating guide 2 and its associated phase shifter 21. The radiating guide is, for example, a resonant slotted guide 22. The phase shifter comprises an input 27 and an output 28. The input 27 receives the wave 23 transmitted by a microwave feed 4. This input 27 is therefore arranged facing this feed 4. The output 28 of the phase shifter is arranged facing the radiating guide 2. The wave 24 leaving the phase shifter, and phase shifted, penetrates into the slotted guide to radiate in a known manner. The slots of the guide 2 can be arranged on its small side or on its major side, the slots being oriented towards the outside of the cylinder. At its end opposite the phase shifter 21, the guide can be closed over a microwave short circuit, in which case it operates in resonance mode. The guide 2 helps to form the antenna beam 8 when its associated phase shifter 21 is illuminated by a feed 4. As has already been stated, the rotation of the beam around the cylinder is achieved by activating the microwave feeds 4 in turn. This, for example, forms a scan in azimuth mode.

To obtain a misalignment bearing-wise 29, it is possible to adjust the transmit frequency. In this case, the resonant mode guides are replaced by progressive mode guides. In this case, a guide is then closed over a microwave load. An offset of 1% in the frequency band, for example, can thus induce an offset of around 1°.

Figure 3:
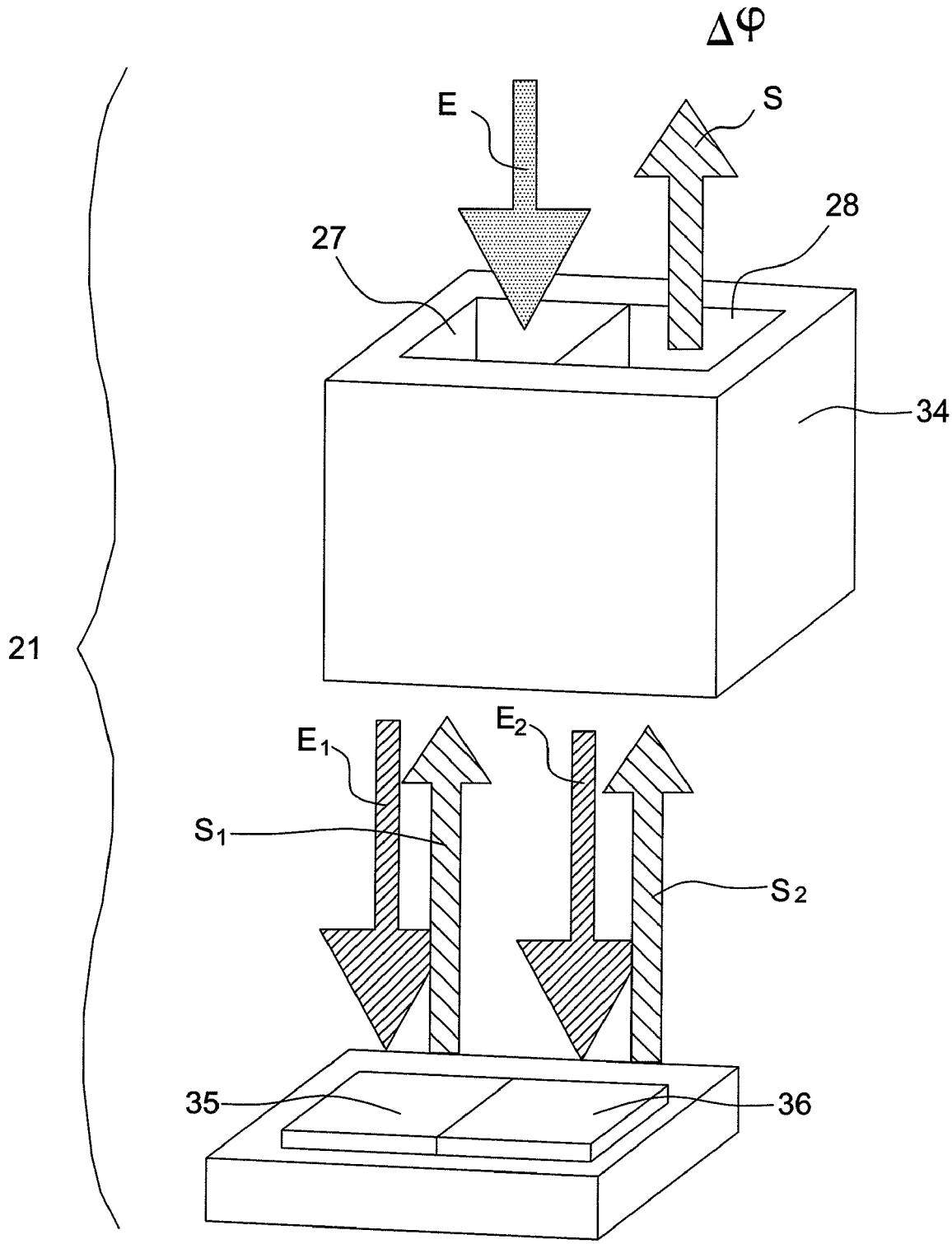
FIG. 3, by an exploded view, one possible embodiment of a phase shifter used in an antenna according to the invention.

FIG. 3 is an exploded view detailing one possible embodiment of the phase shifter 21 of FIG. 2. This phase shifter consists of a 3 dB coupler in waveguide 34 form and a pair of phase-shifting cells 35, 36. The 3 dB coupler is associated with the pair of phase-shifting cells operating in reflection mode, the output of the coupler being arranged facing the phase-shifting cells. In particular, the incoming wave E from a microwave feed 4, passing through the input 27 of the coupler 34, is split into two incoming waves E1, E2 towards the two phase-shifting cells 35, 36. These two cells reflect these incoming waves with identical phase shifts. The reflected waves S1, S2 enter into the coupler 34 to be recombined together. The resultant wave S then emerges from the output 28 of the coupler, juxtaposed to the input 27, with a phase shift $\Delta\phi$ relative to the incoming wave E. The resultant output wave S penetrates into the slotted guide 2. In a known manner, a phase-shift value $\Delta\phi$ applied to the incoming wave reflected in the waveguide 2 creates a given angular offset of the antenna beam 8. This offset is obtained in a plane perpendicular to the axis 20 of the waveguides, therefore, for example, in azimuth. The electronically scanned 10 of the antenna beam 8 is performed in a known manner by varying the phase shift $\Delta\phi$. This electronically scanned 10 is superimposed on the rotation of the antenna beam 8 around the cylinder forming the antenna.

Figure 4A:
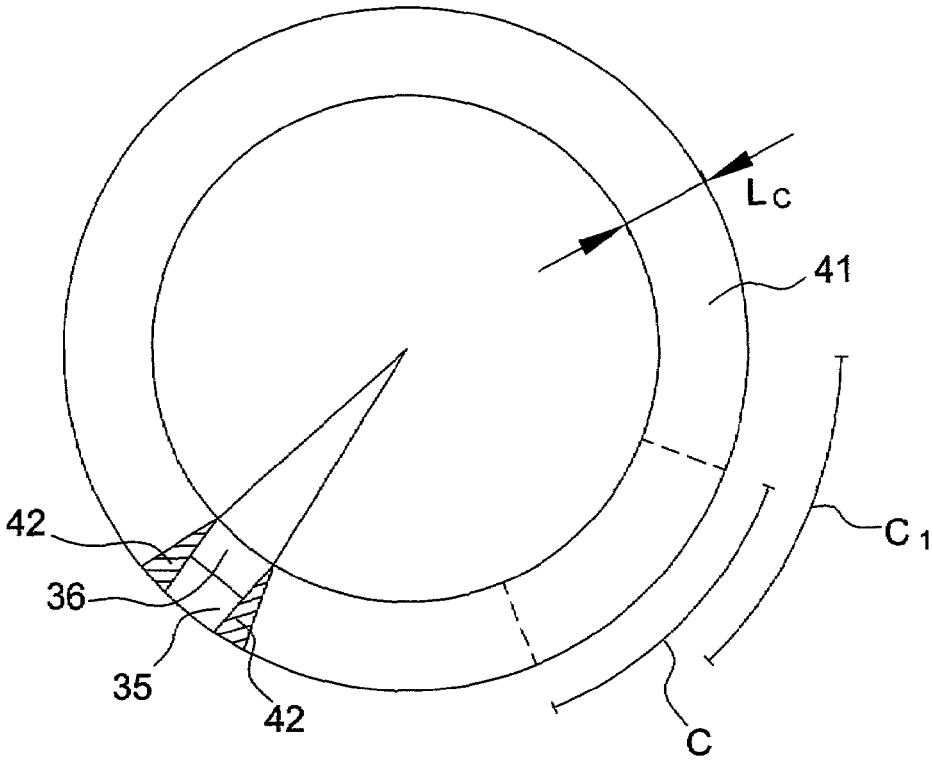
FIGS. 4*a*, 4*b* and 4*c*, possible embodiments of the array of phase shifters implemented in an antenna according to the invention.
Figure 4B:
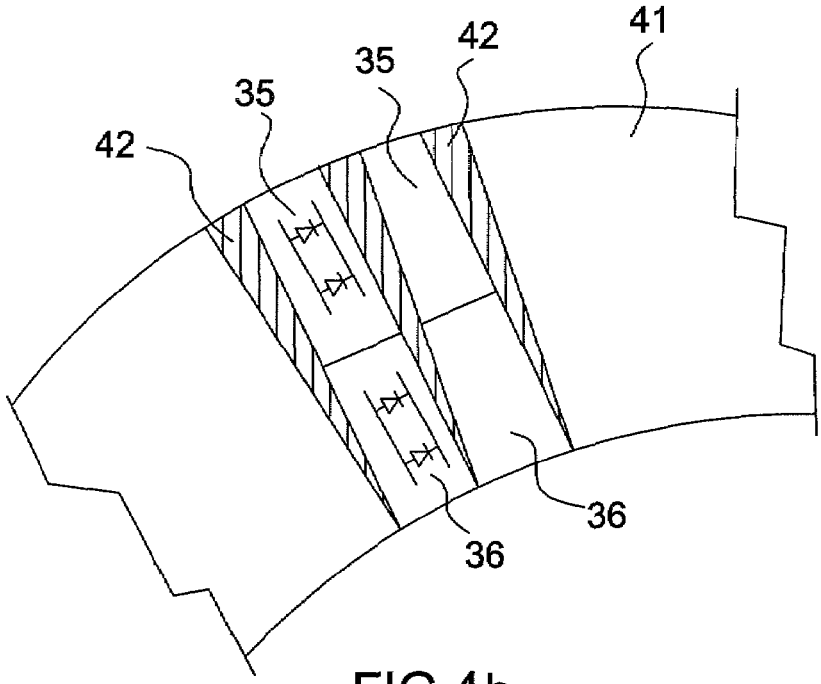

FIGS. 4*a* and 4*b* illustrate one possible embodiment of the array of phase shifters 3, FIG. 4*b* being a partial view of FIG. 4*a*. More particularly, these figures show one embodiment of the array formed by the phase-shifting cells 35, 36 of the phase shifters 21. These cells are, for example, mounted on a circular printed circuit 41 having a given width Lc. Two cells 35, 36 assigned to the same phase shifter are contiguous and arranged radially. Two pairs of cells are radially separated by an area 42. This area is, for example, a printed conductive track. Its width, which is not constant, roughly corresponds to the width of the walls of a 3 dB coupler. The 3 dB couplers are, for example, soldered on these areas 42. The printed circuit 41 is, for example, fixed on a circular mechanical structure which is not shown. This structure also supports, for example, the internal wall 5.

Each phase-shifting cell 35, 36 comprises a microwave circuit and a conductive plane roughly parallel to the microwave circuit. The microwave circuit and the conductive plane can advantageously be produced in the printed circuit 41 which is then of multilayer type. The main function of the conductive plane is to reflect the waves E1, E2 described previously, then the microwave circuit produces the phase shift.

The phase-shifting cells 35, 36 are, for example, produced using diodes as described in the French patent application published under the number 2 807 213. In this case, the applied phase-shift $\Delta\phi$ depends on the state of the diodes.

The phase shifts can also be produced by variable inductors or capacitors. To this end, it is possible to use tunable MEMS circuits. Circuits in MEMS (micro-electromechanical systems) technologies combine the microelectronics of semiconductors and micromachining technology, making it possible to produce systems on a chip. Thus, in the context of the invention, it is possible to use tunable MEMS circuits as described, for example, in the article by C. M. Tasseti, G. Bazin-Lissorgues, J. P. Gilles, P. Nicole, "New Tunable MEMS Inductors Design for RF and Microwave Applications", MEMSWAVE' conference 2003, 2-4 Jul. 2003, Toulouse, France. In this case, the microwave circuit of the phase-shifting cells 35, 36 therefore comprises the abovementioned MEMS. The applied phase shift then depends on the impedance presented by these MEMS, this impedance, inductive or capacitive, being controllable.

One advantage over diode-based phase shifters is obtaining a finer step interval in the applied phase shifts $\Delta\phi$ to the incident waves. With diode-based phase shifters, it is possible to achieve a control on four bits, i.e. a step of $1/2^4=1/16$. Tunable MEMS-based phase-shifting cells make it possible to obtain a control equivalent to six bits, for example, i.e. a step of $1/2^6=1/64$. Reducing the phase-shift $\Delta\phi$ step makes it possible in particular to reduce the spurious radiations. The control circuits of the phase-shifting cells are not shown in FIGS. 4*a* and 4*b*. These circuits can, for example, be located on the back of the printed circuit supporting the phase-shifting cells. This printed circuit can, advantageously, be of multilayer type to enable electrical links to pass between the phase-shifting cells and their control circuits.

Figure 4C:
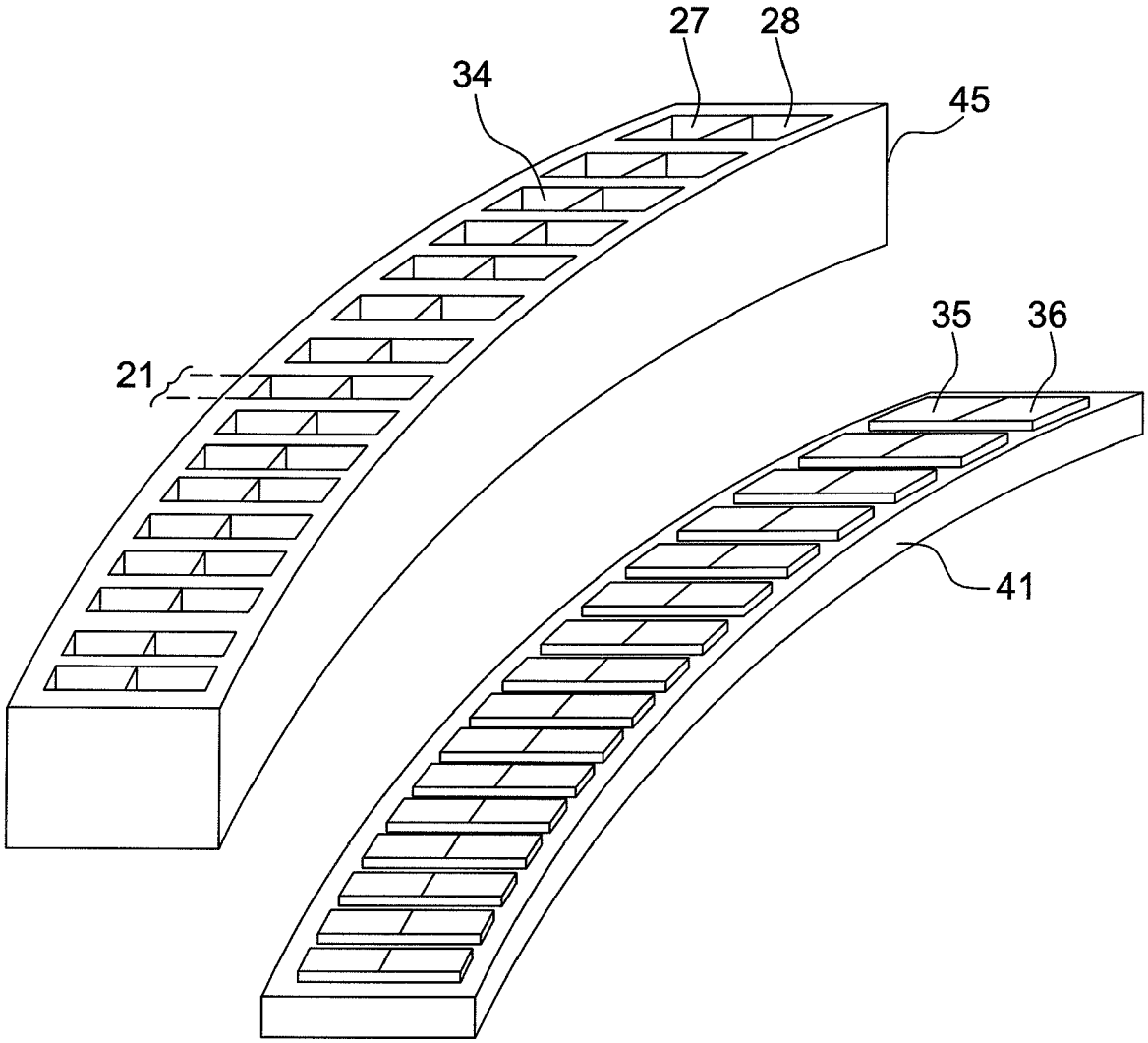

FIG. 4*c* illustrates one possible embodiment of the set of 3 dB couplers 21 that are coupled to the printed circuit 41. These couplers 21, each coupled to a pair of phase-shifting cells 35, 36, can form a single circular part 45. This part is then added to the printed circuit 41. The guides 34 forming the couplers are, for example, machined in one and the same metal part. The radiating waveguides 2 are then arranged facing the waveguides forming the outputs of the 3 dB couplers.

Figure 5:
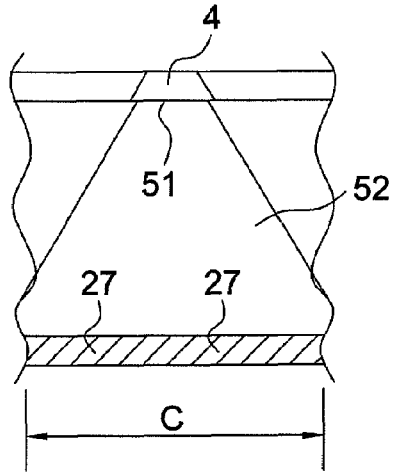
FIG. 5, a method of lighting the phase shifters by microwave feeds.

FIG. 5 illustrates the lighting mode of the phase shifters by the microwave feeds 4. More particularly, FIG. 5 illustrates the lighting of the inputs 27 of the phase shifters by a feed 4. This feed typically comprises a horn 51. This horn is itself supplied by a microwave wave. This is the microwave wave to be transmitted, which is itself previously amplified.

The horn 51 radiates this wave to the phase shifters. The radiation 52 produced by the feed 4 lights the phase shifters 21 over a length C, this length being circular as illustrated by the representation of this length in FIG. 4*a*. The microwave feed adjacent to the feed 4 represented in FIG. 5 produces a radiation which lights the phase shifters over a length C1. This length overlaps the previous length C as illustrated by FIG. 4*a*.

Figure 6:
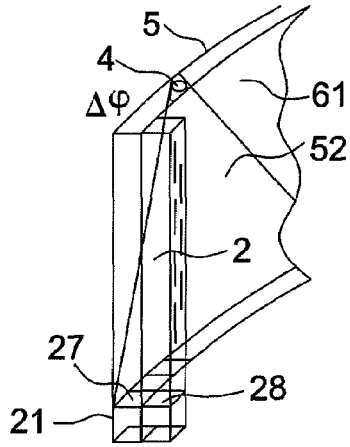
FIG. 6, an illustration of the radiation produced by a microwave feed between the internal and external walls of an antenna according to the invention.

FIG. 6 is a perspective view illustrating the radiation of FIG. 5. The feed 4 fixed at the top of the internal wall 5 lights the free space between the internal cylindrical wall 5 and the wall formed by the non-radiating faces of the waveguides 2. More particularly, the feed 4 lights the inputs 27 of the phase shifters 21. The waves transmitted by the feed 4 therefore enter into the phase shifters 21, are phase shifted, then penetrate into the waveguides 2, the inputs of which are linked to the outputs 28 of the phase shifters.

The microwave feeds 4, in particular the horns 51, are, for example, linked to a microwave switch. This switch comprises an input which receives the wave to be transmitted and several outputs, each linked to a horn.

Figure 7:
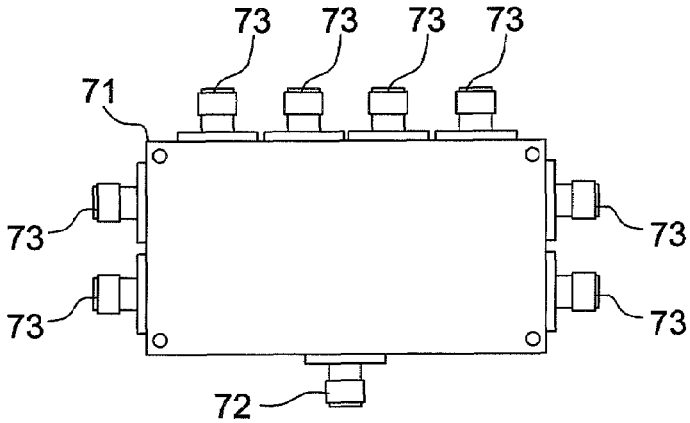
FIG. 7, an exemplary embodiment of a device switching a microwave wave between the different feeds distributed around the cylinder forming the antenna.

FIG. 7 illustrates one example of microwave switching device which can advantageously be used. This switching device is, for example, a switch 71 of SP8T type comprising one input and eight outputs. This SP8T-type switch can be PIN-diode-based or MEMS-based. The switch 71 comprises one input 72 and eight outputs 73. The input 72 and the outputs 73 are, for example, adapted for connection to coaxial-type microwave lines. Such a line links each horn 51 to the switch 71. The wave entering into the switch is thus switched in turn to the different outputs. This way, the horns arranged all around the internal cylinder are supplied in turn as described previously.

The cylinder forming an antenna according to the invention can have a base forming a circle as illustrated by the figures. It can, however, have a base not forming a circle. In this case, the forms of the arrays of phase-shifting cells, in particular the printed circuit 41, and of the arrays of couplers, are adapted. An antenna according to the invention, cylindrical in shape, can easily be fitted to the mast of a ship, for example, the antenna then being arranged around the mast.

Another advantage of an antenna according to the invention is, in particular, the technological simplicity. The various embodiments illustrated by the figures have shown the technological simplicity and the types of components used.

This antenna also presents low losses because of the components used which themselves introduce little in the way of losses.

Regarding the dimensions, the length of the radiating guides 2 can be around 30 centimetres, for example, and the diameter of the cylinder can be around 1 metre. The result is a relatively compact antenna with little bulk.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. A cylindrical electronically scanned antenna, comprising:

a set of radiating guides arranged in cylinder form to produce an antenna beam;

an array of 3 dB couplers in waveguide form having inputs and an outputs, the inputs of which are lit by a set of microwave feeds, the outputs of each coupler being coupled to the input of a radiating guide;

an array of pairs of phase-shifting cells, each coupled to a 3 dB coupler, an incoming wave (E) from the microwave feeds being phase-shifted by a controllable phase shift ($\Delta\phi$), the angular offset of the antenna beam being dependent on the phase shift ($\Delta\phi$), wherein the microwave feeds are arranged on a cylindrical circumference inside the cylinder formed by the set of radiating guides so that each feed lights a part of the array of couplers, the microwave feeds being activated in turn.

2. The antenna according to claim 1, wherein the microwave feeds are horns linked to a microwave line switching device, each horn supplied by a line.

3. The antenna according to claim 2, wherein the switching device is an SP8T-type device.

4. The antenna according to claim 3, wherein the switch is MEMS-based.

5. The antenna according to claim 1, wherein the incoming wave (E) entering the input of a coupler is split into two waves (E1, E2), these two waves each being reflected on a phase-shifting cell with identical phases and being recombined into a resultant phase-shifted wave (S) leaving via the output of the coupler juxtaposed to the input.

6. The antenna according to claim 5, wherein the phase-shifting cells comprise diodes, the applied phase shift being dependent on the state of the diodes.

7. The antenna according to claim 5, wherein the phase-shifting cells comprise tunable MEMS, the applied phase shift being dependent on the impedance of the MEMS, this impedance being controllable.

8. The antenna according to claim 1, wherein the microwave feeds are arranged on an internal cylindrical wall, the feeds lighting the coupler in the available space between the internal wall and the radiating guides.

9. The antenna according to claim 1, wherein the radiating guides are slotted guides.

10. A cylindrical electronically scanned antenna, comprising:

a set of radiating guides arranged in cylinder form to produce an antenna beam;

an array of 3 dB couplers in waveguide form having inputs and an outputs, the inputs of which are lit by a set of microwave feeds, the outputs of each coupler being coupled to the input of a radiating guide;

an array of pairs of phase-shifting cells, each coupled to a 3 dB coupler, an incoming wave (E) from the microwave feeds being phase-shifted by a controllable phase shift ($\Delta\phi$), the angular offset of the antenna beam being dependent on the phase shift ($\Delta\phi$), wherein the microwave feeds are horns linked to a microwave line switching device, each horn supplied by a line.

11. The antenna according to claim 10 wherein the microwave feeds are arranged on a cylindrical circumference inside the cylinder formed by the set of radiating guides so that each feed lights a part of the array of couplers, the microwave feeds being activated in turn.

* * * * *